US009199289B2

(12) United States Patent
Domani et al.

(10) Patent No.: US 9,199,289 B2
(45) Date of Patent: Dec. 1, 2015

(54) METHOD FOR PRODUCING A PROFILE FROM A SHEET-METAL STRIP

(75) Inventors: Guenter Domani, Weissensberg (DE); Christoph Wiedner, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 477 days.

(21) Appl. No.: 13/547,947

(22) Filed: Jul. 12, 2012

(65) Prior Publication Data

US 2013/0180303 A1 Jul. 18, 2013

(30) Foreign Application Priority Data

Jul. 13, 2011 (DE) ..... 10 2011 079 095

(51) Int. Cl.

| | |
|---|---|
| ***B21B 1/098*** | (2006.01) |
| ***B21B 1/22*** | (2006.01) |
| ***B21B 1/095*** | (2006.01) |
| *B21D 5/08* | (2006.01) |

(52) U.S. Cl.

CPC . *B21B 1/22* (2013.01); *B21B 1/095* (2013.01); *B21B 1/098* (2013.01); *B21B 1/224* (2013.01); *B21D 5/08* (2013.01)

(58) Field of Classification Search

CPC B21B 1/22; B21B 2001/221; B21B 2263/02; B21B 1/095; B21B 1/098; B21B 2261/00; B21B 2261/04; B21B 2261/043; B21B 2261/065; B21B 2261/10; B21B 2265/10; B21B 1/085; B21B 1/0855; B21D 5/00; B21D 5/08; B21D 5/083; B21D 11/08; B21D 17/04; B21D 31/005; B21D 31/055; B21D 35/006; B21D 31/006; E04C 3/07

USPC ..... 72/199, 365.2, 379.2, 377, 252.5, 206, 72/224, 226, 234, 181

See application file for complete search history.

(56) References Cited

U.S. PATENT DOCUMENTS

| | | | | |
|---|---|---|---|---|
| 1,343,753 | A * | 6/1920 | Sloper | 72/177 |
| 4,007,617 | A * | 2/1977 | Falk et al. | 72/234 |
| 4,279,139 | A * | 7/1981 | Schmitz | 72/234 |
| 4,433,565 | A * | 2/1984 | Preller | 72/177 |
| 4,856,313 | A * | 8/1989 | Mirura et al. | 72/234 |
| 4,969,346 | A * | 11/1990 | Bosl et al. | 72/177 |

(Continued)

FOREIGN PATENT DOCUMENTS

| | | |
|---|---|---|
| CH | 568 111 A5 | 10/1975 |
| CN | 87 1 01818 A | 1/1988 |

(Continued)

OTHER PUBLICATIONS

German Search Report, dated Feb. 24, 2012, 6 pages total.

(Continued)

*Primary Examiner* — Peter DungBa Vo
*Assistant Examiner* — Joshua D Anderson
(74) *Attorney, Agent, or Firm* — Crowell & Moring LLP

(57) ABSTRACT

A method for producing a profile from a sheet-metal strip is disclosed. The sheet-metal strip is bent at least twice during a first stage, where, as viewed in the cross-section of the sheet-metal strip, a center section as well as two flank sections are formed, which project angularly from two opposing end regions of the center section. During a second stage following the first stage, the center section is compressed by two complementary roller arrangements which engage on the two opposing end regions of the center section, and the sheet-metal strip is thereby locally thickened.

14 Claims, 2 Drawing Sheets

(56) References Cited

U.S. PATENT DOCUMENTS

| | | | | | |
|---|---|---|---|---|---|
| 5,107,695 | A * | 4/1992 | Vandenbroucke | ..... | 72/129 |
| 5,253,501 | A * | 10/1993 | Spath | ..... | 72/167 |
| 5,829,295 | A * | 11/1998 | Voth et al. | ..... | 72/181 |
| 7,096,702 | B2 * | 8/2006 | McDonald | ..... | 72/181 |
| 7,343,767 | B2 * | 3/2008 | Bauer et al. | ..... | 72/252.5 |
| 2009/0133460 | A1 * | 5/2009 | Hermann et al. | ..... | 72/181 |

FOREIGN PATENT DOCUMENTS

| | | | |
|---|---|---|---|
| DE | 23 02 389 | B2 | 7/1973 |
| DE | 101 32 960 | A1 | 1/2003 |
| EP | 0 736 345 | A1 | 10/1996 |
| EP | 2 025 420 | A1 | 2/2009 |
| EP | 2 065 532 | A1 | 6/2009 |
| EP | 2 085 163 | A1 | 8/2009 |
| EP | 2 108 469 | A1 | 10/2009 |
| JP | 06 246301 | A | 9/1994 |
| RU | 2 015 774 | C1 | 7/1994 |
| RU | 2 056 192 | C1 | 3/1996 |
| RU | 2 108 180 | C1 | 4/1998 |
| RU | 2 108 279 | C1 | 4/1998 |
| SU | 1787637 | A1 | 1/1993 |
| WO | WO 2010/009751 | A1 | 1/2010 |

OTHER PUBLICATIONS

European Search Report, dated Dec. 20, 2012, 6 pages.
Chinese Office Action dated Apr. 27, 2015, with English translation (Fourteen (14) pages).

* cited by examiner

METHOD FOR PRODUCING A PROFILE FROM A SHEET-METAL STRIP

This application claims the priority of German Patent Document No. DE 10 2011 079 095.0, filed Jul. 13, 2011, the disclosure of which is expressly incorporated by reference herein.

BACKGROUND AND SUMMARY OF THE INVENTION

The invention relates to a method for producing a profile from a sheet-metal strip.

Roll profiling methods are known in which rail profiles are produced from a sheet-metal strip through bending operations. Such a method is found in European Patent Document No. EP 0 736 345 A1 for example. In addition, locally reducing the wall thickness of the metal in the course of a roll profiling method is known from EP 2 025 420 A1 and EP 2 085 163 A1 for example. It is thereby possible to take into consideration that for structural reasons a profile frequently does not absolutely have to have a wall thickness that is constant over the profile circumference. In particular, the wall thickness may be reduced in the less stressed sections of the profile thereby saving material.

In the case of the above-mentioned thinning-out method, the expense is all the greater, the greater the portion of cross-sectional areas in the overall profile cross-section that is to be thinned out. As a result, a profile that is supposed to have a large wall thickness only at selective points and a small wall thickness in the predominant part of the cross-section frequently cannot be produced economically with a thinning-out method. Moreover, the maximum sheet-metal difference that can be achieved with thinning out is limited.

When locally thinning out the profile sheet in a roll profiling method, accumulations of material may occur in the area of the wall thickness reduction. Providing for these accumulations of material at the bends in the profile is known from EP 2 065 532 A1. According to EP 2 065 532 A1, the accumulations of material are linked however with the wall thickness reduction so that often they may not be positioned freely.

Compressing and thickening the strip edge of the sheet-metal strip during profile production is known from WO 2010/009751 A1. Also in this case, the thickening of the wall thickness cannot be positioned freely.

The object of the invention is disclosing a method for producing a profile from a sheet-metal strip which makes it possible to produce profiles that have especially diverse designs with a high level of economy and reliability.

According to the invention, a method for producing a profile from a sheet-metal strip is provided in which the sheet-metal strip is bent at least twice during a first stage so that, as viewed in the cross-section of the sheet-metal strip, a center section as well as two flank sections are formed, which project angularly from two opposing end regions of the center section, and during a second stage following the first stage, the center section is compressed by two complementary roller arrangements, which engage on the two opposing end regions of the center section, and the sheet-metal strip is thereby locally thickened.

A fundamental idea of the invention lies in the fact that the sheet-metal strip is bent at least twice and the center section that emerges in the process is compressed on its two ends such that a local thickening develops in the area of the center section. According to the invention, profile cross-sectional regions with increased wall thickness are therefore obtained not by adjacent regions being thinned out, but by targeted thickening. The double bending allows the compression forces to be introduced into the center section especially simply and reliably, because the front sides of the opposing end regions of the center section are freely accessible due to the double bending. Because the bends may basically be introduced at any point in the cross-section, according to the invention the thickenings are also able to be freely positioned in the cross-section to the greatest possible extent.

Because of the invention, one or more thickenings can be created at almost any point in the sheet-metal strip. In the process, it is also economically possible to create a cross-section in which only small areas have a large wall thickness and large areas have a small wall thickness.

The method according to the invention is preferably a cold rolling method, which can be carried out in particular on a cold rolling mill. According to the invention, at least one of the roller arrangements has at least one recess into which the material flows during the compression process during the second stage and thereby creates at least one local thickening.

According to the invention, the compression is carried out in the plane of the center section, i.e., the compression forces act at least approximately parallel to the flat sides of the center section. The bending is carried out according to the invention around bending axes, which run at least approximately parallel to the longitudinal axis of the sheet-metal strip. The at least double bending may take place simultaneously or successively. Accordingly, the first stage may also include several individual stages. Each roller arrangement may have one roller or several coaxially disposed rollers. The sheet-metal strip may be in particular a metal sheet-metal strip.

The bending during the first stage may preferably be carried out using roll profiling. However, other forming techniques are also possible in principle. The bending during the first stage may be carried out in particular without appreciably influencing the wall thickness, i.e., during the first stage, the wall thickness changes by a maximum of 10%, preferably a maximum of 5% or 1%, wherein, during the first stage, preferably only a reduction in the wall thickness and no increase in the wall thickness is planned.

Basically, it may also be provided according to the invention that the bends are retained and are also still present in the finished profile. The profile production may be further simplified hereby. Another alternative is neutralizing at least one of the bends again after the compression and thickening. In this case, this bend is merely an auxiliary structure for producing the thickening and is no longer present in the finished profile. According to this embodiment, the freedom in the positioning of the thickening is increased even further.

According to the invention, the first roller arrangement has a first rotational axis and the second roller arrangement has a second rotational axis, wherein the rotational axes expediently run parallel. A roller gap is formed between the two roller arrangements through which the sheet-metal strip is guided.

It is advantageous, for example, for an especially efficient initiation of force that, during compression, the center section, as viewed in the cross-section of the sheet-metal strip, runs at least approximately perpendicular to the rotational axis of the first roller arrangement and/or the rotational axis of the second roller arrangement. An at least approximately perpendicular course may be understood in particular in that the angle between the center section, in particular between the flat sides of the center section, and the rotational axes is 90°±10°, in particular 90°±5°, preferably 90°±1°. According to this embodiment, the center section is therefore guided through the roller gap at least approximately perpendicular to the roller axes so that the compression forces applied by the rollers lie in the plane of the center section. As a rule, it is advantageous to avoid undercuts in the strip cross-section so that the above-mentioned angle may be expediently less than 90°.

Another preferred embodiment of the invention lies in that the first flank section, as viewed in the cross-section of the sheet-metal strip, projects at least approximately at a right angle from the center section, and/or that the second flank section, as viewed in the cross-section of the sheet-metal strip, projects at least approximately at a right angle from the center section. Because of the arrangement at a right angle, the end regions of the center section are especially easily accessible to the roller arrangements so that, on the one hand, the equipment expense is especially low. On the other hand, such an arrangement makes it possible to support the flank sections and/or the center section during compression in an especially simple and reliable manner thereby avoiding undesired deformations. Projecting at at least approximately a right angle may be understood in particular in that the respective flank section and the center section, in particular the flat sides of the respective flank sections and the flat sides of the center section, enclose an angle of 90°±10°, in particular 90°±5°, preferably 90°±1°. As a rule, it is advantageous to avoid undercuts in the strip cross-section so that the cited angle may be expediently less than 90°.

Another embodiment of the invention lies in that the two flank sections project from the center section on opposing flat sides of the center section. Accordingly, the three sections form at least approximately a Z-shape in the cross-section of the sheet-metal strip, wherein the two outer legs of the Z-shape are formed by the flank sections and the center leg of the Z-shape by the center section. According to this embodiment, the two roller arrangements are able to support the center section on both sides during compression so that the manufacturing precision and manufacturing reliability are able to be increased further.

Moreover, it is expedient that the sheet-metal strip is locally thickened during the second stage on at least one of the end regions of the center section, in particular in both end regions. This embodiment takes into consideration that the end regions of the center section, i.e., the transition areas between the center section and the bent flange areas, are frequently especially stressed in a profile. The embodiment provides for strengthening these especially stressed areas through targeted local thickening.

The method according to the invention may also be combined with other methods that influence the thickness of the sheet-metal method such as, for example, strip profile rolling or strip edge compression. By combining the local thickenings produced according to the invention with locally thinned-out areas, which are produced on the same sheet-metal strip during the second stage or during an additional process step, it is possible to make a very large wall thickness area economically usable, thereby enabling material use to be optimized, e.g., in the production of profile rails.

It is especially preferred that during the second stage, at least one of the two flank sections, in particular both flank sections, are thinned out by the roller arrangements. According to this embodiment, thickenings and thinned-out areas are produced at the same time during the second stage with the same complementary roller arrangements so that especially large wall thickness variations are able to be produced in the profile with especially little effort.

In order to thicken larger areas of the sheet-metal strip, it may be advantageous that, during a third stage following the second stage, the center section is further compressed by two additional complementary roller arrangements, which engage on the two opposing end regions of the center section and, in doing so, increase the local thickening. Additional compression stages of this type may also be provided so that the center section is reduced in height several times and the thickening is likewise increased several times.

A broadening of the profile during compression in the second stage may be avoided for example by lateral supporting rollers and/or by an offset in the roller arrangements. However, the method can also be carried out possibly without the use of such auxiliary tools or auxiliary geometry.

Another advantageous development of the invention lies in that the sheet-metal strip is bent at least four times during the first stage, so that, as viewed in the cross-section of the sheet-metal, a further center section is formed, wherein a flank section projects angularly from each of the opposing regions thereof, and that during the second stage following the first stage, the two center sections are compressed by the two complementary roller arrangements.

Accordingly, two center sections are compressed at the same time by the two roller arrangements and, in doing so, the sheet-metal strip is locally thickened on at least two points in the cross-section of the sheet-metal strip so that the economy of the method may be increased even further.

It is especially expedient that both center sections, as viewed in the cross-section of the sheet-metal strip, run at least approximately parallel. The compression force may be initiated hereby especially effectively in both center sections at the same time. An at least approximately parallel course may be understood in that the two center sections, in particular the flat sides thereof, enclose an angle of less than 10°, in particular of less than 5° or 1°.

Moreover, it is advantageous that a common flank section is provided, which projects angularly from the two center sections. Accordingly, the sheet-metal strip may have a U-shape in the cross-section of the sheet-metal strip in some sections after the first stage, wherein the side legs of the U-shape are formed by the two center sections and the center leg of the U-shape is formed by the common flank section.

According to the invention, a profile shape is produced during the first stage, which includes at least one at least approximately perpendicular section, the center section. In the following, this profile shape is guided through complementary roller arrangements that form a roller gap, which is smaller than the perpendicular center section, which produces a compression of the center section.

The invention will be explained in greater detail in the following on the basis of preferred exemplary embodiments, which are depicted schematically in the enclosed figures.

DETAILED DESCRIPTION OF THE DRAWINGS

Elements having the same effect are identified in the Figures with the same reference numbers.

FIGS. 1 to 4 show cross-sectional views of a sheet-metal strip in successive process stages of a first exemplary embodiment of the method according to the invention.

Figure 1:
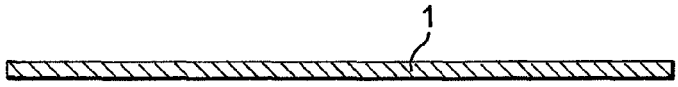
FIGS. 1 to 4 are cross-sectional views of a sheet-metal strip in successive process stages of a method according to the invention in accordance with a first exemplary embodiment.

The starting material for the method is an unbent, flat sheet-metal strip 1 as depicted in FIG. 1.

During a first stage of the method, the sheet-metal strip 1 is bent twice, preferably by roll profiling, wherein the bending is performed around bending axes that extend in the longitudinal direction of the sheet-metal strip, i.e., perpendicular to the drawing plane of FIGS. 1 to 4. As a result of the bending, the stepped structure depicted in FIG. 2 with a center section 10 and two flank sections 13 and 14 disposed angularly thereto, especially at a right angle, is obtained, wherein the flank sections 13 and 14 project from the center section 10 on opposing end regions 23 or 24. The two flank sections 13 and 14 point in opposing directions in this case, i.e., they each project from the center section 10 from opposing flat sides 17 or 18. Thus, a structure that is bent twice at a right angle in cross-section is obtained, in which the center section 10 is arranged perpendicular to the two flank sections 13 and 14 running between the two flank sections 13, 14.

Figure 2:
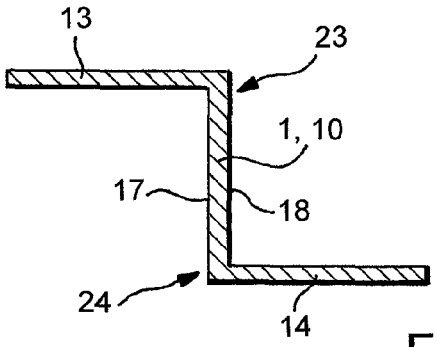
Figure 3:
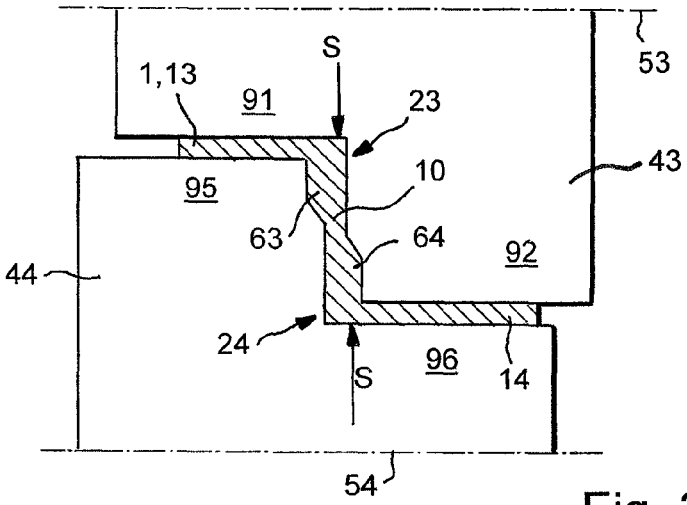
Figure 4:
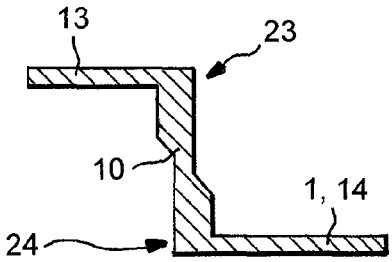

Then, the sheet-metal strip 1 deformed as per FIG. 2 is guided through a roll gap shown in FIG. 3, which is configured between two corresponding roller arrangements 43 and 44, wherein the roller arrangements 43 and 44 can each be rotated around a rotational axis 53 or 54. The sheet-metal strip 1 is guided between the two roller arrangements 43 and 44 in such a way that, as viewed in the cross-section of the sheet-metal strip 1, the two flank sections 13 and 14 run parallel to the two rotational axes 53 and 54 and the center section 10 runs perpendicular to the two rotational axes 53 and 54. When the sheet-metal strip 1 is guided through, as indicated by arrow S, compression forces act on the end regions 23, 24 of the center section 10 directed parallel to the plane and at the flat sides 17, 18 of the center section 10, which compress and thicken the center section 10 in the end regions 23, 24 thereof. During compression, displaced material is able to flow into the recesses 63 and 64, which are formed on the two roller arrangements 43 or 44 in the area of the end regions 23 or 24, and thereby form thickenings. The result is the sheet-metal strip 1 shown in FIG. 4, in which the sheet metal is thickened at the end regions 23, 24 of the center section. In order to guarantee an especially reliable flow of material, the length of the recesses 63 and 64, as viewed perpendicular to the two rotational axes 53 and 54, is less than the bent length of the center section 10.

As FIG. 3 further shows, the first roller arrangement 43 has a smaller diameter area 91 and a larger diameter area 92. Similarly, the second roller arrangement 44 has a smaller diameter area 96 and a larger diameter area 95, wherein the smaller diameter area 91 of the first roller arrangement 43 is opposite from the larger diameter area 95 of the second roller arrangement 44 and the larger diameter area 92 of the first roller arrangement 43 is opposite from the smaller diameter area 96 of the second roller arrangement 44. The first flank section 13 is guided between the areas 91 and 95 and, in the process, is preferably thinned out. The second flank section 14 is guided between the areas 92 and 96 and, in the process, is likewise thinned out. In the second stage during compression, the center section 10 is supported transverse to the direction of the compression forces S by the two larger diameter areas 95 and 92, which are adjacent to the flat sides 17 or 18, thereby preventing an undesired deformation of the center section 10.

Figure 5:
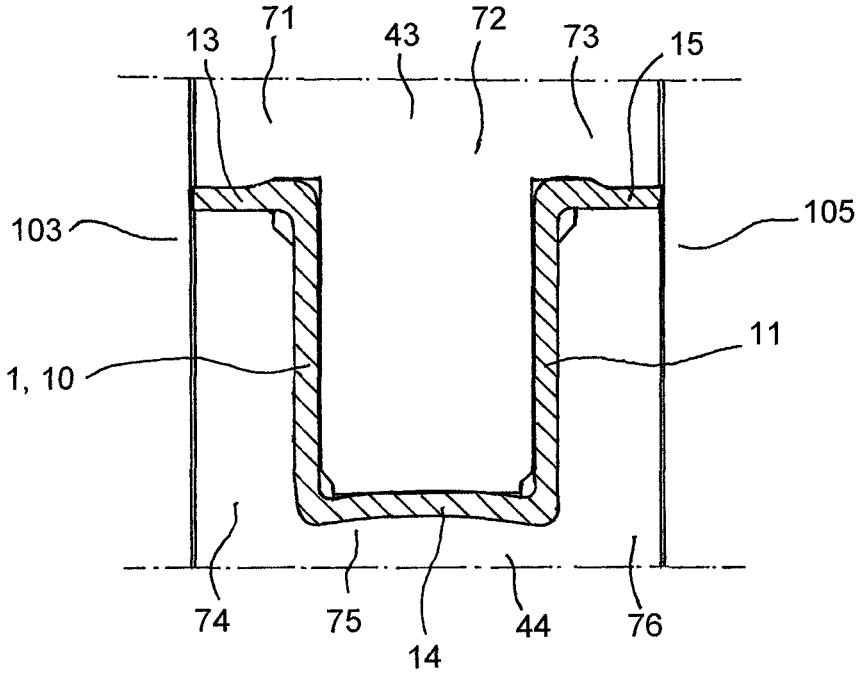
FIG. 5 is a cross-sectional view of a sheet-metal strip in a process stage corresponding to FIG. 3 of a method according to the invention according to a second embodiment.

FIG. 5 illustrates the second step, i.e., the compression step, according to an alternative embodiment of the invention. According to FIG. 5, the sheet-metal strip is bent four times during the first step so that two parallel center sections 10 and 11 are obtained, which are connected by a common flank section 14. Moreover, another flank section 13 projects from the first center section 10 and another flank section 15 projects from the second center section 11. The common flank section 14 in this case forms a U-shape in cross-section along with the two center sections 10 and 11. Overall, the sheet-metal strip is hat-shaped in cross-section. In the compression step depicted in FIG. 5, the center sections 10 and 11 are simultaneously compressed and thickened by the two roller arrangements 43, 44.

In the case of the exemplary embodiment in FIG. 5, the two roller arrangements 43, 44 are each designed to have mirror symmetry. The first roller arrangement 43 has a smaller diameter area 71, next to it a central larger diameter area 72 and next to that another smaller diameter area 73. The corresponding second roller arrangement 44 has a larger diameter area 74, next to it a smaller diameter area 75 and next to that another larger diameter area 76. In this case, the areas 71 and 74, 72 and 75, as well as 73 and 76 are respectively opposite from one another. During compression, the areas 74 and 72 support the first center section 10 on the flat sides thereof and the areas 72 and 76 support the second center section 11 on the flat sides thereof.

As the exemplary embodiment in FIG. 5 further shows, at least one of the outer flank sections 13 or 15 may be supported laterally by supporting rollers 103 or 105. These supporting rollers 103 or 105 may in particular be part of the second roller arrangement 44. One or more lateral supporting rollers, which act on at least one end region of the sheet-metal strip 1, may be provided also with other exemplary embodiments described.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for producing a profile from a sheet-metal strip, comprising the steps of:

bending the sheet-metal strip at least twice during a first stage such that, as viewed in a cross-section of the sheet-metal strip, a center section and two flank sections are formed, wherein the two flank sections respectively project angularly from two opposing end regions of the center section and define a length therebetween, wherein the two opposing end regions define a plane of the center section that runs along the length of the center section; and during a second stage following the first stage, thickening the center section of the sheet-metal strip by compressing the center section parallel to the plane of the center section by two complementary roller arrangements which engage on the two opposing end regions of the center section.

2. The method according to claim 1:

wherein a first roller arrangement of the two complementary roller arrangements has a first rotational axis and a second roller arrangement of the two complementary roller arrangements has a second rotational axis;

and wherein during the compressing, the center section, as viewed in the cross-section of the sheet-metal strip, is at least approximately perpendicular to the first rotational axis and/or the second rotational axis.

3. The method according to claim 1:

wherein a first flank section of the two flank sections, as viewed in the cross-section of the sheet-metal strip, projects at least approximately at a right angle from the center section;

and wherein a second flank section of the two flank sections, as viewed in the cross-section of the sheet-metal strip, projects at least approximately at a right angle from the center section.

4. The method according to claim 1, wherein the two flank sections project from the center section on opposing flat sides of the center section.

5. The method according to claim 1, wherein the sheet-metal strip is thickened during the second stage on at least one of the two opposing end regions of the center section.

6. The method according to claim 1, wherein during the second stage, at least one of the two flank sections is thinned by the two roller arrangements.

7. The method according to claim 1:

wherein the sheet-metal strip is bent at least four times during the first stage such that, as viewed in the cross-section of the sheet-metal strip, a second center section is formed, wherein two flank sections respectively project angularly from two opposing end regions of the second center section;

and wherein during the second stage following the first stage, the second center section is compressed by the two complementary roller arrangements.

8. The method according to claim 7, wherein the center section and the second center section, as viewed in the cross-section of the sheet-metal strip, are at least approximately parallel.

9. The method according to claim 7, wherein during the first stage, one of the two flank sections of the center section and one of the two flank sections of the second center section form a common flank section which projects angularly from the center section and the second center section.

10. A method for producing a profile from a sheet-metal strip, comprising the steps of:

forming a center section and two flank sections in the sheet-metal strip by bending the sheet-metal strip at least twice during a first stage, wherein the two flank sections respectively project angularly from two opposing end regions of the center section and define a length therebetween, wherein the two opposing end regions define a plane of the center section that runs along the length of the center section; and during a second stage following the first stage, thickening the center section of the sheet-metal strip by compressing the center section parallel to the plane of the center section by two complementary roller arrangements.

11. The method according to claim 10, wherein a first roller of the two complementary roller arrangements has a first area with a first diameter and a second area with a second diameter, wherein the first diameter is smaller than the second diameter, and wherein a second roller of the two complementary roller arrangements has a first area with a first diameter and a second area with a second diameter, wherein the first diameter is smaller than the second diameter.

12. The method according to claim 11, wherein the first area of the first roller is disposed opposite the second area of the second roller and wherein the second area of the first roller is disposed opposite the first area of the second roller.

13. The method according to claim 11, wherein the first roller of the two complementary roller arrangements has a third area with the first diameter and wherein the second roller of the two complementary roller arrangements has a third area with the second diameter.

14. The method according to claim 13, wherein the first area and the third area of the first roller are disposed opposite the second area and the third area of the second roller and wherein the second area of the first roller is disposed opposite the first area of the second roller.

* * * * *